US008884999B2

(12) United States Patent
Min

(10) Patent No.: US 8,884,999 B2
(45) Date of Patent: Nov. 11, 2014

(54) GAMMA VOLTAGE GENERATING APPARATUS AND ORGANIC LIGHT EMITTING DEVICE INCLUDING THE SAME

(75) Inventor: Byung Chan Min, Yongin-si (KR)

(73) Assignee: Samsung Display Co., Ltd. (KR)

( * ) Notice: Subject to any disclaimer, the term of this patent is extended or adjusted under 35 U.S.C. 154(b) by 197 days.

(21) Appl. No.: 13/614,889

(22) Filed: Sep. 13, 2012

(65) Prior Publication Data

US 2013/0271505 A1 Oct. 17, 2013

(30) Foreign Application Priority Data

Apr. 17, 2012 (KR) ..... 10-2012-0039853

(51) Int. Cl.
*G09G 3/36* (2006.01)

(52) U.S. Cl.
USPC ..... 345/690; 345/89

(58) Field of Classification Search
CPC ..... G09G 2320/0276; G09G 2320/0271; G09G 2320/0626; G09G 2360/16; G09G 3/3607; H04N 3/127
USPC ..... 345/89, 690
See application file for complete search history.

(56) References Cited

U.S. PATENT DOCUMENTS

2009/0213042 A1* 8/2009 Hagino et al. ..... 345/55
2011/0175937 A1 7/2011 Weng
2012/0032995 A1* 2/2012 Lee ..... 345/690

FOREIGN PATENT DOCUMENTS

KR 10-2006-0128141 12/2006
KR 10-2010-0094815 8/2010

* cited by examiner

*Primary Examiner* — Kevin M Nguyen
(74) *Attorney, Agent, or Firm* — Knobbe Martens Olson & Bear LLP

(57) ABSTRACT

A gamma voltage generator, which can improve display quality, and an organic light emitting device including the gamma voltage generator are provided. The gamma voltage generator includes a voltage divider that generates first to $n^{th}$ voltages sequentially arranged in descending order of electric potential, and a gamma voltage output unit that receives the first to $n^{th}$ voltages and outputs first to $n^{th}$ gamma voltages sequentially arranged in descending order of electric potential, wherein in a first mode, the first to $n^{th}$ voltages are equal to the first to $n^{th}$ gamma voltages, respectively, and in a second mode, the $a^{th}$ to $n^{th}$ gamma voltages are higher than the $a^{th}$ to $n^{th}$ voltages, respectively, where $1<a<n$, and each of a and n is a natural number.

16 Claims, 7 Drawing Sheets

GAMMA VOLTAGE GENERATING APPARATUS AND ORGANIC LIGHT EMITTING DEVICE INCLUDING THE SAME

CROSS-REFERENCE TO RELATED APPLICATIONS

This application claims priority from Korean Patent Application No. 10-2012-0039853 filed on Apr. 17, 2012 in the Korean Intellectual Property Office, the disclosure of which is incorporated herein by reference in its entirety.

BACKGROUND

1. Field

The present disclosure relates to a gamma voltage generator which can improve display quality, and an organic light emitting device including the gamma voltage generator.

2. Description of the Related Technology

In line with the tendency toward lightweightedness and slimness of portable display devices such as notebook computers, cellular phones or portable multimedia players (PMPs) as well as displays for home use, such as a TV or a monitor, a variety of flat display devices are widely used. There are various types of flat display devices, including a liquid crystal display device, an organic light emitting device and an electrophorectic display device. Among the flat display devices, the organic light emitting device is increasingly demanded owing to its various advantages, including low power consumption, high brightness, high contrast ratio, and facilitated enabling of a flexible display.

The organic light emitting device implements an image using an organic light emitting diode (OLED) as a light-emitting element. The OLED emits light with brightness corresponding to the current flowing therein. The organic light emitting device includes a plurality of OLEDs and may display an image by controlling gray scales of the respective OLEDs by controlling the current flowing in each OLED. The organic light emitting device may include a plurality of thin film transistors to control the current flowing in each OLED.

Leakage current may be generated in the thin film transistor for controlling the current flowing in each OLED of the organic light emitting device. Since the generated leakage current may be induced into the OLED, the current flowing in the OLED may not be properly controlled. In particular, it is difficult to control the brightness in a low gray scale, that is, in a case where the OLED is driven with a low current. Therefore, the organic light emitting device may undergo deterioration in display quality due to the occurrence of leakage current, particularly deterioration in the display quality in a low gray scale.

SUMMARY OF CERTAIN INVENTIVE ASPECTS

Embodiments of the present invention provide a gamma voltage generator, which can improve display quality.

Embodiments of the present invention also provide an organic light emitting device including a gamma voltage generator, which can improve display quality.

The above and other objects of the present invention will be described in or be apparent from the following description of certain embodiments.

According to one aspect of the present invention, there is provided a gamma voltage generator including a voltage divider that generates first to $n^{th}$ voltages sequentially arranged in descending order of electric potential, and a gamma voltage output unit that receives the first to $n^{th}$ voltages and outputs first to $n^{th}$ gamma voltages sequentially arranged in descending order of electric potential, wherein in a first mode, the first to $n^{th}$ voltages are equal to the first to $n^{th}$ gamma voltages, respectively, and in a second mode, the $a^{th}$ to $n^{th}$ gamma voltages are higher than the $a^{th}$ to $n^{th}$ voltages, respectively, where $1<a<n$, and each of a and n is a natural number.

According to another aspect of the present invention, there is provided a gamma voltage generator including a voltage divider that generates first to $n^{th}$ voltages sequentially arranged in descending order of electric potential, and a gamma voltage output unit that receives the first to $n^{th}$ voltages and outputs first to $n^{th}$ gamma voltages sequentially arranged in descending order of electric potential, wherein the first to $(a-1)^{th}$ gamma voltages are equal to the first to $(a-1)$ gamma voltages, respectively, and the $a^{th}$ to $n^{th}$ gamma voltages are higher than the $a^{th}$ to $n^{th}$ voltages, respectively, where $1<a<n$, and each of a and n is a natural number.

According to still another aspect of the present invention, there is provided an organic light emitting device including an organic light emitting display panel that displays an image according to a data signal, a data driver that generates the data signal, and a gamma voltage generator that generates first to $n^{th}$ gamma voltages to the data driver, wherein the gamma voltage generator includes a voltage divider that generates first to $n^{th}$ voltages sequentially arranged in descending order of electric potential, and a gamma voltage output unit that receives the first to $n^{th}$ voltages and outputs first to $n^{th}$ gamma voltages sequentially arranged in descending order of electric potential, wherein in a first mode, the first to $n^{th}$ voltages are equal to the first to nth gamma voltages, respectively, and in a second mode, the $a^{th}$ to $n^{th}$ gamma voltages are higher than the $a^{th}$ to $n^{th}$ voltages, respectively, where $1<a<n$, and each of a and n is a natural number.

According to still another aspect of the present invention, there is provided an organic light emitting device including an organic light emitting display panel that displays an image according to a data signal, a data driver that generates the data signal, and a gamma voltage generator that generates first to $n^{th}$ gamma voltages to the data driver, wherein the gamma voltage generator includes a voltage divider that generates first to $n^{th}$ voltages sequentially arranged in descending order of electric potential, and a gamma voltage output unit that receives the first to $n^{th}$ voltages and outputs first to $n^{th}$ gamma voltages sequentially arranged in descending order of electric potential, wherein the first to $(a-1)^{th}$ gamma voltages are equal to the first to $(a-1)$ gamma voltages, respectively, and the $a^{th}$ to $n^{th}$ gamma voltages are higher than the $a^{th}$ to $n^{th}$ voltages, respectively, where $1<a<n$, and each of a and n is a natural number.

As described above, in the gamma voltage generator according to embodiments of the present invention, display quality can be improved.

In addition, in the organic light emitting device including a gamma voltage generator according to embodiments of the present invention, display quality can be improved.

BRIEF DESCRIPTION OF THE DRAWINGS

The above and other features and advantages of the present invention will become more apparent by describing in detail certain embodiments thereof with reference to the attached drawings in which.

DETAILED DESCRIPTION OF CERTAIN INVENTIVE EMBODIMENTS

The present invention will now be described more fully hereinafter with reference to the accompanying drawings, in which certain embodiments of the invention are shown. This invention may, however, be embodied in different forms and should not be construed as limited to the embodiments set forth herein. Rather, these embodiments are provided so that this disclosure will be thorough and complete, and will convey the scope of the invention to those skilled in the art. The same reference numbers generally indicate the same components throughout the specification. In the attached figures, the thickness of layers and regions is exaggerated for clarity.

It will also be understood that when a layer is referred to as being "on" another layer or substrate, it can be directly on the other layer or substrate, or intervening layers may also be present. In contrast, when an element is referred to as being "directly on" another element, there are no intervening elements present. Hereinafter, embodiments of the present invention will be described in further detail with reference to the accompanying drawings.

Figure 1:
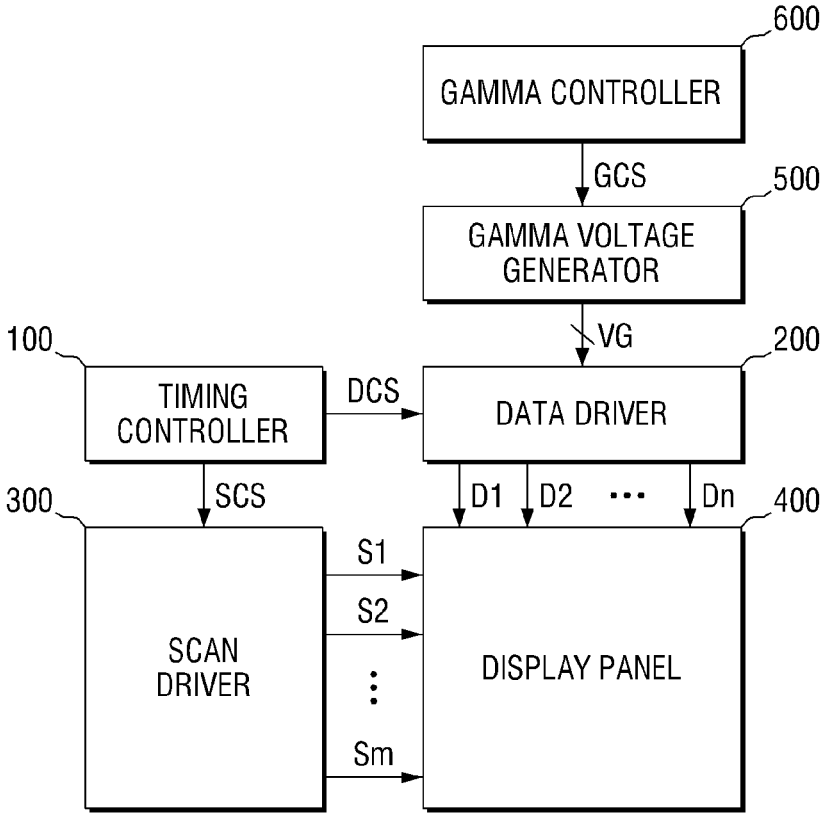
FIG. 1 is a block diagram of an organic light emitting device according to an embodiment of the present invention.

FIG. 1 is a block diagram of an organic light emitting device according to an embodiment of the present invention.

The organic light emitting device according to an embodiment of the present invention includes a data driver 200, a display panel 400 and a gamma voltage generator 500.

The data driver 200 receives a data control signal DCS from a timing controller 100 to be described below, and a gamma voltage VG from the gamma voltage generator 500. The data control signal DCS may include gray scale data of an image. The gamma voltage VG includes a reference for sizes of data signals D1, D2, . . . , Dn corresponding to the gray scale data of image according to a set gamma curve. Accordingly, the data driver 200 generates the data signals D1, D2, . . . , Dn from the data control signal DCS and the gamma voltage VG, and provides the generated data signals D1, D2, . . . , Dn to the display panel 400.

The display panel 400 includes a plurality of pixels and may display an image by controlling gray scales of the plurality of pixels. According to some embodiments, the plurality of pixels may be a set of green, red and blue pixels. According to some other embodiments, the plurality of pixels may be a set of green, red, blue and white pixels. According to some other embodiments, the display panel 400 may include a set of pixels having the same color, for example, a set of black-and-white pixels. It may be determined whether the plurality of pixels of the display panel 400 receive data signals D1, D2, . . . , Dn by scan signals S1, S2, . . . , Sm to be described later, and gray scales corresponding to the data signals D1, D2, . . . , Dn may be displayed.

Figure 2:
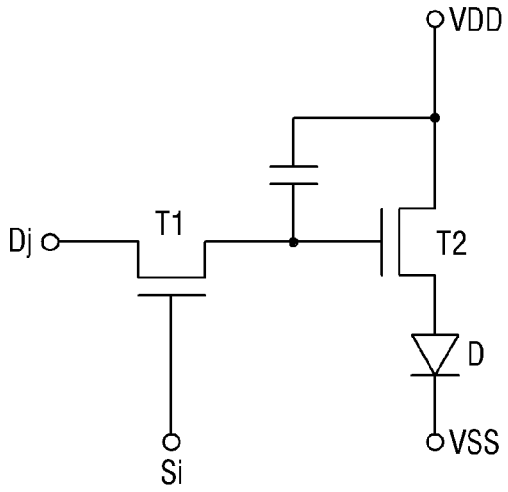
FIG. 2 is a circuit diagram of a pixel included in the organic light emitting device shown in FIG. 1.

FIG. 2 is a circuit diagram of a pixel included in the embodiment of an organic light emitting device shown in FIG. 1. The pixel included in the display panel 400 will be described in more detail with reference to FIG. 2.

One pixel of the display panel 400 may include an OLED (D), a first transistor T1 and a second transistor T2.

The first transistor T1 may control a data signal Dj corresponding to a scan signal Si to be transmitted to a gate of a second transistor T2. For example, when the scan signal Si is high, the first transistor T1 may transmit the data signal Dj to the gate of the second transistor T2, and when the scan signal Si is low, the first transistor T1 may prevent the data signal Dj from being transmitted to the gate of the second transistor T2.

The second transistor T2 may control the current flowing in the OLED (D) in response to the data signal Dj transmitted through the first transistor T1. For example, when the data signal Dj is high, the second transistor T2 may control the current to flow OLED (D), and when the data signal Dj is low, the second transistor T2 may prevent the current from flowing in the OLED (D). Leakage current may be generated in the second transistor T2. If the generated leakage current is induced into the OLED (D), the second transistor T2 cannot completely control the current flowing in the OLED (D). Therefore, display quality of the display panel may be deteriorated due to the leakage current generated at the second transistor T2. In particular, the display quality of an image with a low gray scale operating in a low current may be deteriorated.

The OLED (D) emits light corresponding to the current flowing therein. For example, the higher brightness of the light emitted from the OLED (D), the more the current flowing in the OLED (D). As described above, the current flowing in the OLED (D) is controlled by the second transistor T2 so as to correspond to the data signal Dj. If leakage current is generated, the current flowing in the OLED (D) may not be completely controlled by the second transistor T2, thereby deteriorating the display quality. While FIG. 2 shows that the first and second transistors T1 and T2 are NMOS transistors, aspects of the present invention are not limited thereto. The first and second transistors T1 and T2 may be PMOS transistors in other embodiments.

Referring back to FIG. 1, the gamma voltage generator 500 may generate a gamma voltage VG to transmit the same to the data driver 200. The gamma voltage VG may be a set of a plurality of voltage signals corresponding to values of a plurality of gray scale data Dj based on a gamma curve set in the display device. The gamma voltage generator 500 will be described further below.

The organic light emitting device may further include a timing controller 100. The timing controller 100 may control the data driver 200 and the scan driver 300 to display a desired image on the display panel 400. The timing controller 100 may generate a data control signal DCS for controlling the data driver 200 to transmit the same to the data driver 200. The timing controller 100 may generate a scan control signal SCS for controlling the scan driver 300 to transmit the same to the scan driver 300.

The organic light emitting device may further include the scan driver 300. The scan driver 300 may receive the scan control signal SCS to then generate the scan signals S1, S2, . . . , Sm in response to the scan control signal SCS. The scan signals S1, S2, . . . , Sm are transmitted to the display panel 400 to control a determination of whether the plurality of pixels included in the display panel 400 receive the data signals D1, D2, . . . , Dn or not.

The organic light emitting device may further include a gamma controller 600. In order to control the operation mode of the gamma voltage generator 500 or to change the gamma voltage VG by changing the gamma curve, the gamma controller 600 may generate the gamma control signal GCS to then transmit the same to the gamma voltage generator 500. According to some embodiments, the gamma controller 600 may be incorporated into the timing controller 100. According to some other embodiments, the gamma controller 600 may not be provided. If the gamma controller 600 is not provided, the gamma control signal GCS may be generated by a central processing unit (not shown) incorporated in the display device.

Figure 3:
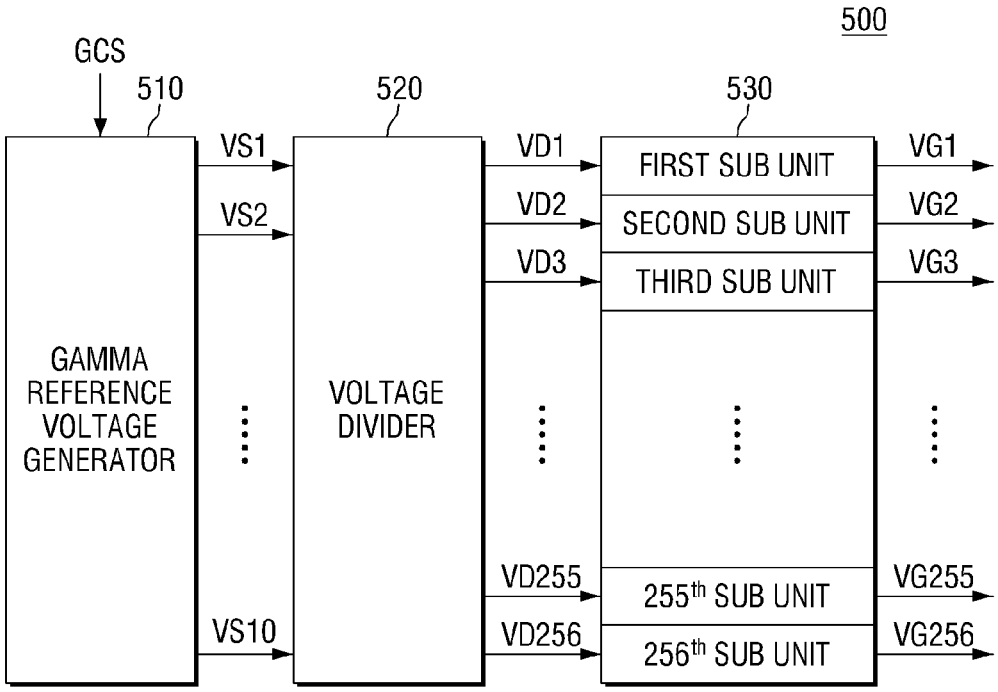
FIG. 3 is a block diagram of a gamma voltage generator according to an embodiment of the present invention.

FIG. 3 is a block diagram of a gamma voltage generator according to an embodiment of the present invention. The gamma voltage generator 500 will be described in more detail with reference to FIG. 3.

Referring to FIG. 3, the gamma voltage generator 500 may include a voltage divider 520 and a gamma voltage output unit 530.

The voltage divider 520 may generate first to $256^{th}$ voltages VD1, . . . , VD256 to then transmit the same to the gamma voltage output unit 530. The first to $256^{th}$ voltages VD1, . . . , VD256 may be sequentially arranged in descending order of electric potential. The electric potential of the first voltage VD1 may be highest and the electric potential of the $256^{th}$ voltage VD256 may be lowest. The first to $256^{th}$ voltages VD1, . . . , VD256 may be generated by dividing electric potentials between the first voltage VD1 and the $256^{th}$ voltage VD256. According to some embodiments, the first to $256^{th}$ voltages may be changed by setting the gamma curve based on the gamma control signal GCS. While FIG. 3 shows that 256 voltages are generated by the voltage divider 520, aspects of the present invention are not limited thereto. The number of voltages generated by the voltage divider 520 may be higher or lower in other embodiments.

Hereinafter, the voltage divider 520 will be described in more detail with reference to FIG. 4.

Figure 4:
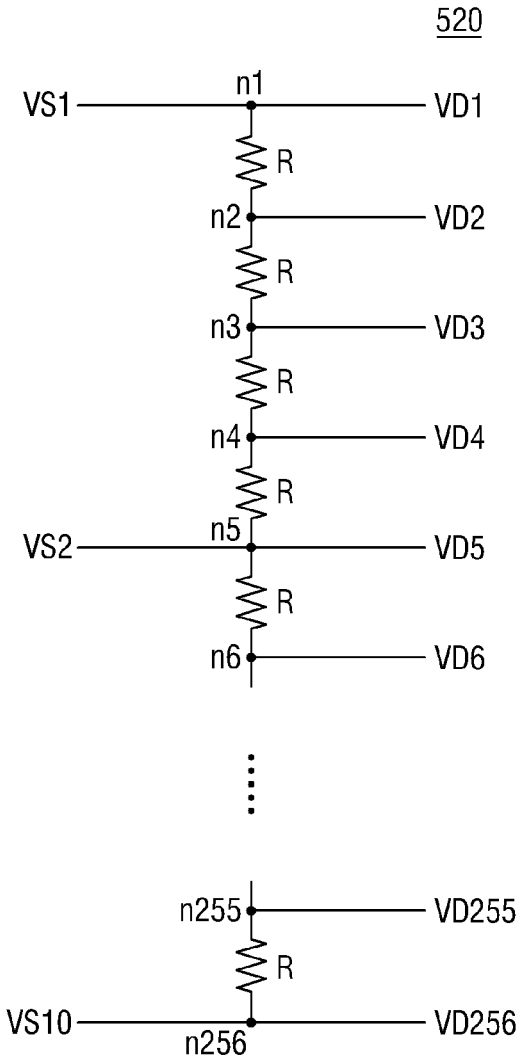
FIG. 4 is a circuit diagram of a voltage divider according to an embodiment of the present invention.

FIG. 4 is a circuit diagram of a voltage divider according to an embodiment of the present invention.

Referring to FIG. 4, the voltage divider 520 may include a resistor array including a plurality of resistors R arranged in series. Values of the respective resistors R may be equal to each other. According to some embodiments, the values of the respective resistors R may not be equal to each other. The resistor array may divide the electric potential between the first voltage VD1 and the $256^{th}$ voltage VD256. The electric potential of a first node n1 may be a first voltage VD1 and the electric potential of a $256^{th}$ node n256 may be a $256^{th}$ voltage VD256. The electric potentials of second to $255^{th}$ nodes n2, . . . , n255, which are divided between the first node n1 and the $256^{th}$ node n256 by the resistor array may be the second to $255^{th}$ voltages VD2, . . . , VD255, respectively. According to some embodiments, the resistor array may include a single resistor string.

According to some embodiments, the voltage divider 520 may receive first to $10^{th}$ gamma reference voltages VS1, . . . VS10 from a gamma reference voltage generator 510 to be described below. While FIGS. 3 and 4 show there are ten gamma reference voltages aspects of the present invention are not limited thereto and the number of gamma reference voltages may be higher or lower in other embodiments. The first to $10^{th}$ gamma reference voltages VS1, . . . , VS10 may be sequentially arranged in descending order of electric potential. The electric potential of the first gamma reference voltage VS1 may be highest and the electric potential of the $10^{th}$ gamma reference voltage VS10 may be lowest. The first to $256^{th}$ voltages VD1, . . . , VD256 may be generated by changing the first to $10^{th}$ gamma reference voltages VS1, . . . VS10. The first gamma reference voltage VS1 may be supplied to the first node n1 to make the electric potential of the first voltage VD1 equal to that of the first gamma reference voltage VS1. The 10th gamma reference voltage VS10 may be supplied to the $256^{th}$ node n256 to make the electric potential of the $256^{th}$ voltage VD256 equal to that of the $10^{th}$ gamma reference voltage VS10. The second to $9^{th}$ gamma reference voltages VS2, . . . , VS9 may be supplied to one selected from the second to $255^{th}$ nodes n2, . . . , n255 to make the electric potential of the voltage output from the selected node equal to that of the supplied gamma reference voltage. While FIG. 4 shows that the second gamma reference voltage VS2 is supplied to the fifth node, aspects of the present invention are not limited thereto. The second gamma reference voltage VS2 may be supplied to various nodes other than the fifth node. As described above, the gamma reference voltages VS1, . . . , VS10 offer references to the voltage divider 520 to generate the first to $256^{th}$ voltages VD1, VD256, thereby controlling values of the first to $256^{th}$ voltages VD1, . . . , VD256.

Referring back to FIG. 3, the gamma voltage output unit 530 may receive the first to $256^{th}$ voltages VD1, . . . , VD256 from the voltage divider 520 to then generate the first to $256^{th}$ gamma voltages VG1, . . . , VG256. The first to $256^{th}$ gamma voltages VG1, . . . , VG256 generated from the gamma voltage output unit 530 may be supplied to the data driver 200. The first to $256^{th}$ gamma voltages VG1, . . . , VG256 may be included in the gamma voltage VG. While FIG. 3 shows that the gamma voltage VG includes 256 gamma voltages aspects of the present invention are not limited thereto and the number of gamma voltages may be higher or lower in other embodiments.

The gamma voltage output unit 530 may operate in a first mode or a second mode. In the first mode, the first to $256^{th}$ gamma voltages VG1, . . . , VG256 may be equal to the first to $256^{th}$ voltages VD1, . . . , VD256, respectively. In the second mode, the first to $(a-1)^{th}$ gamma voltages VG1, . . . , VGa-1 may have the same electric potentials as those of the first to $(a-1)^{th}$ voltages VD1, . . . , VDa-1, respectively, and the $a^{th}$ to $256^{th}$ gamma voltages VGa, . . . , VG256 may have electric potentials higher than those of the $a^{th}$ to $256^{th}$ voltages VDa, . . . , VD256, respectively, where $1<a\leq256$ and a is a natural number. Therefore, the electric potentials of the gamma voltages VGa, . . . , VG256 corresponding to relatively low gray scales are higher in the second mode than in the first mode. Therefore, the value of the data signal Dj of the low gray scale is larger in the second mode than in the first mode. In addition, since a larger amount of current flows in the OLED (D) in the second mode than in the first mode, less leakage current affects the gray scale in the second mode than in the first mode, thereby improving the display quality in the low gray scale.

When b is an arbitrary natural number between a and 256, in the second mode, the $b^{th}$ gamma voltage VGb may be a value between a $b^{th}$ gamma voltage has a value between a $(b-1)^{th}$ gamma voltage VGb-1 and a $b^{th}$ voltage VDb. According to some embodiments, in the second mode, the $b^{th}$ gamma voltage VGb may be a median value of the $(b-1)^{th}$ gamma voltage VGb-1 and the $b^{th}$ voltage VDb, that is, the same value as '(VGb-1+VDb)/2', which will later be described in more detail with reference to FIGS. 6 to 8.

The gamma voltage output unit 530 includes first to $256^{th}$ sub units. The first to $256^{th}$ sub units output the first to $256^{th}$ gamma voltages VG1, . . . , VG256, respectively.

Figure 5:
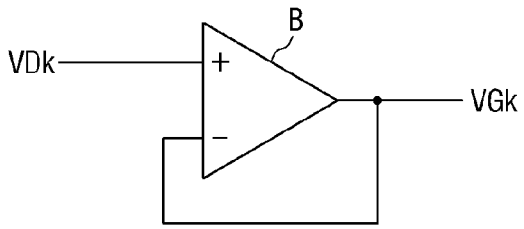
FIG. 5 is a block diagram of a $k^{th}$ sub unit according to an embodiment of the present invention.

When k is an arbitrary natural number between 1 and a−1, the $k^{th}$ sub unit will be described in more detail with reference to FIG. 5. FIG. 5 is a block diagram of a $k^{th}$ sub unit according to an embodiment of the present invention.

Referring to FIG. 5, the $k^{th}$ sub unit includes a buffer B that receives a $k^{th}$ voltage VDk and outputs a $k^{th}$ gamma voltage VGk. As shown in FIG. 5, the buffer B may be implemented using an OP-Amp, but aspects of the present invention are not limited thereto. The buffer B functions to isolate an input port and an output port but does not change values of the input and output ports. Therefore, the $k^{th}$ voltage VDk and the $k^{th}$ gamma voltage VGk may be substantially the same. The $k^{th}$ sub unit inputs the $k^{th}$ voltage VDk and outputs the $k^{th}$ gamma voltage VGk, which is substantially the same as the input $k^{th}$ voltage VDk.

Figure 6:
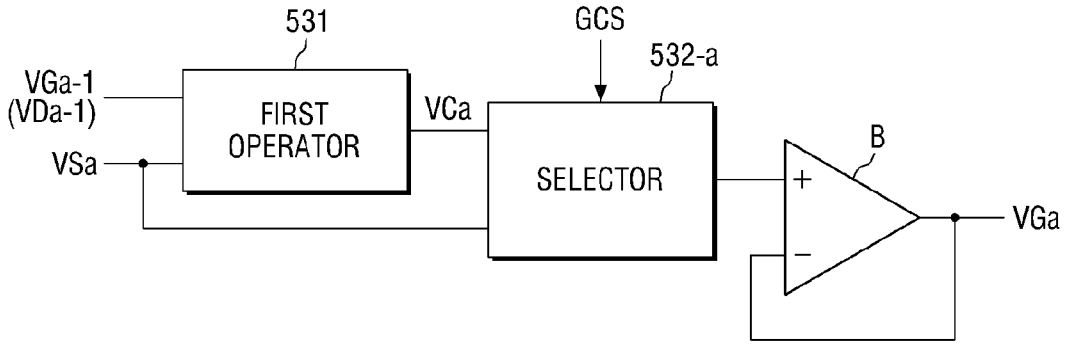
FIG. 6 is a block diagram of an $a^{th}$ sub unit according to an embodiment of the present invention.

The $a^{th}$ sub unit will be described in more detail with reference to FIG. 6. FIG. 6 is a block diagram of an $a^{th}$ sub unit according to an embodiment of the present invention.

Referring to FIG. 6, the $a^{th}$ sub unit may include a first operator 531, a selector 532-*a*, and a buffer B.

The first operator 531 receives the $(a-1)^{th}$ gamma voltage VGa-1 and the $a^{th}$ reference voltage VDa and generates a gamma correction voltage VCa of the $a^{th}$ sub unit. According to some embodiments, the first operator 531 may receive the $(a-1)^{th}$ voltage VDa-1, which is substantially the same as the $(a-1)^{th}$ gamma voltage VGa-1, instead of the $(a-1)^{th}$ gamma voltage VGa-1. The gamma correction voltage VCa of the $a^{th}$ sub unit may be a value between the $(a-1)^{th}$ gamma voltage VGa-1 and the $a^{th}$ voltage VDa. According to some embodiments, the gamma correction voltage VCa of the $a^{th}$ sub unit may be a median value between the $(a-1)^{th}$ gamma voltage VGa-1 and the $a^{th}$ voltage VDa.

Figure 8:
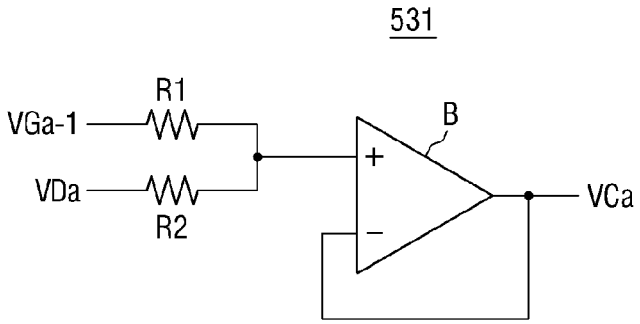
FIG. 8 is a block diagram of a first operator according to an embodiment of the present invention.

The first operator 531 will be described in more detail with reference to FIG. 8. FIG. 8 is a block diagram of a first operator according to an embodiment of the present invention.

Referring to FIG. 8, the first operator 531 may include a first resistor R1, a second resistor R2, and a buffer B. The first resistor R1 may receive the $(a-1)^{th}$ gamma voltage VGa-1 from its one end and may be connected to an input node nil of the buffer B at its other end. The second resistor R2 may receive the $a^{th}$ voltage VSa from its one end and may be connected to the input node nil of the buffer B at its other end. Therefore, when the electric potential of the input node nil of the buffer B is denoted by Vni1, it may be expressed by the following equation:

$$Vni1 = \frac{R2 \times (VGa - 1) + R1 \times Vsa}{R2 + R1}$$

According to some embodiments, the first resistor R1 and the second resistor R2 may have the same resistance value. In this case, Vni1 may be expressed by the following equation:

$$Vni1 = \frac{(VGa - 1) + VSa}{2}$$

The buffer B outputs the gamma correction voltage VCa of the $a^{th}$ sub unit, which has substantially the same value as the electric potential Vn1 of its input node nil.

Referring back to FIG. 6, the selector 532-*a* receives the gamma correction voltage VCa of the $a^{th}$ sub unit and the $a^{th}$ voltage VDa and selectively outputs the gamma correction voltage VCa of the $a^{th}$ sub unit or the $a^{th}$ voltage VDa according to a mode selection signal MSS. According to some embodiments, the selector 532-*a* may be implemented by a 2×1-mux. According to some embodiments, the mode selection signal MSS may be included in the gamma control signal GCS. According to some other embodiments, the mode selection signal MSS may be a signal supplied from the timing controller 100 or CPU, separately from the gamma control signal GCS.

When the mode selection signal MSS is set to a first mode, the selector 532-*a* may output the $a^{th}$ voltage VDa, and when the mode selection signal MSS is set to a second mode, the selector 532-*a* may output the gamma correction voltage VCa of the $a^{th}$ sub unit.

The $a^{th}$ voltage VDa selected by the selector 532-*a* or the gamma correction voltage VCa of the $a^{th}$ sub unit is output to the $a^{th}$ gamma voltage VGa via the buffer B.

When c is an arbitrary number between a and 256, the $c^{th}$ sub unit will be described in more detail with reference to FIG. 7.

Figure 7:
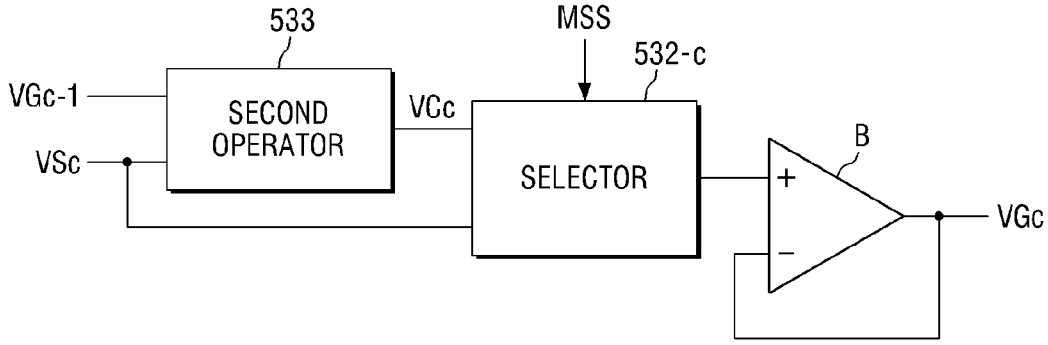
FIG. 7 is a block diagram of a $c^{th}$ sub unit according to an embodiment of the present invention.

FIG. 7 is a block diagram of a $c^{th}$ sub unit according to an embodiment of the present invention.

Referring to FIG. 7, the $c^{th}$ sub unit may include a second operator 533, a selector 532-*c* and a buffer B.

The second operator 533 receives the gamma correction voltage VCc-1 of the $(c-1)^{th}$ sub unit and the $c^{th}$ voltage VDc and generates the gamma correction voltage VCc of the $c^{th}$ sub unit. The gamma correction voltage VCc of the $c^{th}$ sub unit may be a value between the gamma correction voltage VCc-1 of the $(c-1)^{th}$ sub unit and the $c^{th}$ voltage VDc. According to some embodiments, the gamma correction voltage VCc of the $c^{th}$ sub unit may be a median value between the gamma correction voltage VCc-1 of the $(c-1)^{th}$ sub unit and the $c^{th}$ voltage VDc.

The second operator 533 is substantially the same as the first operator 531 shown in FIG. 8, except that it receives the gamma correction voltage VCc-1 of the $(c-1)^{th}$ sub unit, instead of the $(a-1)^{th}$ gamma voltage VGa-1, and the $c^{th}$ voltage VCa, instead of the $a^{th}$ voltage VDa, and outputs the gamma correction voltage VCc of the $c^{th}$ sub unit, instead of the gamma correction voltage VCa of the $a^{th}$ sub unit.

The selector 532-*c* receives the gamma correction voltage VCc of the $c^{th}$ sub unit and the $c^{th}$ voltage VDc and selectively outputs the gamma correction voltage VCc of the $c^{th}$ sub unit and the $c^{th}$ voltage VDc according to the mode selection signal MSS. According to some embodiments, the selector 532-*c* may be implemented by a 2×1-mux. When the mode selection signal MSS is set to the first mode, the selector 532-*c* may output the $c^{th}$ voltage VDc, and when the mode selection signal MSS is set to the second mode, the selector 532-*c* may output the gamma correction voltage VCc of the $c^{th}$ sub unit.

Referring back to FIG. 3, the gamma voltage generator 500 may further include a gamma reference voltage generator 510. The gamma reference voltage generator 510 generates the first to $10^{th}$ gamma reference voltages VS1, . . . , VS10 and supplies the same to the voltage divider 520. While FIG. 3 shows the gamma reference voltage generator 510 generates 10 gamma reference voltage, aspects of the present invention are not limited thereto and the number of gamma reference voltages may vary in other embodiments. The first to $10^{th}$ gamma reference voltages may be sequentially arranged in descending order of electric potential. The first to $10^{th}$ gamma reference voltages VS1, . . . , VS10 are supplied to the voltage divider 520, and the voltage divider 520 generates first to $255^{th}$ voltages VD1, VS255 based on the first to $10^{th}$ gamma reference voltages VS1, . . . , VS10. The gamma reference voltage generator 510 may receive a gamma control signal GCS and may change values of the first to $10^{th}$ gamma reference voltages VS1, . . . , VS10 in response to the gamma control signal GCS.

Figure 9:
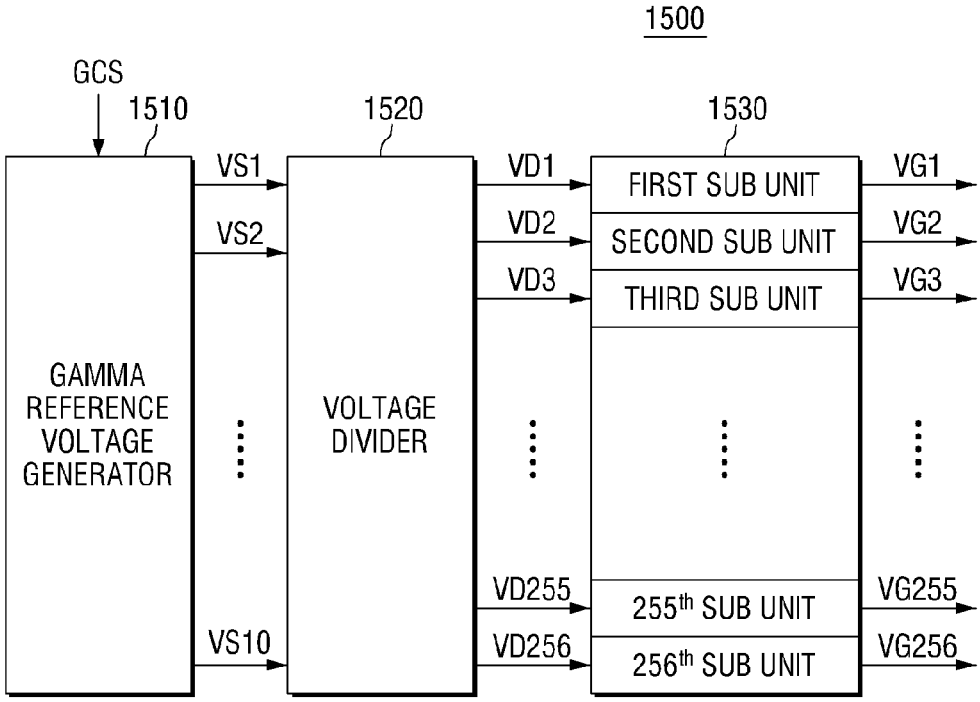
FIG. 9 is a block diagram of a gamma voltage generator according to another embodiment of the present invention.

A gamma voltage generator according to another embodiment of the present invention will be described with reference to FIG. 9. FIG. 9 is a block diagram of a gamma voltage generator according to another embodiment of the present invention.

Referring to FIG. 9, the gamma voltage generator 1500 includes a voltage divider 1520 and a gamma voltage output unit 1530.

The gamma voltage output unit 1530 receives first to $256^{th}$ voltages VD1, . . . , VD256 and generates first to $256^{th}$ gamma voltages VG1, . . . , VG256. The first to $(a-1)^{th}$ gamma voltages VG1, . . . , VGa-1 may be equal to the first to $(a-1)^{th}$ voltages VD1, . . . , VDa-1, respectively. Electric potentials of the $a^{th}$ to 256th gamma voltages VGa, . . . , VG256 may be higher than those of the $a^{th}$ to 256th voltages VDa, . . . , VD256, respectively, where 1<a=<256 and a is a natural number. Therefore, in the gamma voltage generator 1500, the electric potential of the gamma voltage corresponding to a low gray scale is increased, thereby solving the problem of deterioration in display quality of a low gray scale due to leakage current occurring to the OLED (D).

Figure 10:
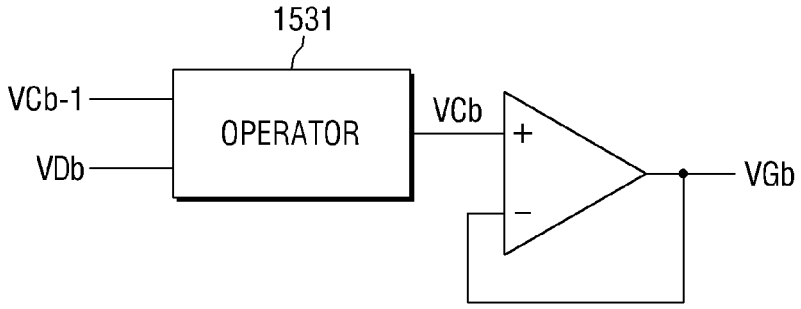
FIG. 10 is a block diagram of a $b^{th}$ sub unit according to another embodiment of the present invention.

When b is an arbitrary natural number between a and 256, a $b^{th}$ sub unit will be described in more detail with reference to FIG. 10. FIG. 10 is a block diagram of a $b^{th}$ sub unit according to another embodiment of the present invention.

Referring to FIG. 10, the $b^{th}$ sub unit may include an operator 1531 and a buffer B.

The operator 1531 receives a gamma correction voltage VCb-1 of a $(b-1)^{th}$ sub unit and a $b^{th}$ voltage VDb and generates a gamma correction voltage VCb of a $b^{th}$ sub unit. However, the operator 1531 included in an $a^{th}$ sub unit may receive a $(b-1)^{th}$ voltage VDb-1, instead of the gamma correction voltage of the $(b-1)^{th}$ sub unit. The gamma correction voltage VCb of the bth sub unit may be a value between the gamma correction voltage VCb-1 of the $(b-1)^{th}$ sub unit and the $b^{th}$ voltage VDb. According to some embodiments, the gamma correction voltage VCb of the $b^{th}$ sub unit may be a median value between the gamma correction voltage VCb-1 of the $(b-1)^{th}$ sub unit and the $b^{th}$ voltage VDb.

The operator 1531 is substantially the same as the first operator 531 shown in FIG. 8, except that it receives the gamma correction voltage VCb-1 of the $(b-1)^{th}$ sub unit, instead of the $(a-1)^{th}$ gamma voltage VGa-1, and the $b^{th}$ voltage VCb, instead of the $a^{th}$ voltage VDa, and outputs the gamma correction voltage VCb of the $b^{th}$ sub unit, instead of the gamma correction voltage VCa of the $a^{th}$ sub unit.

The other configurations of the gamma voltage generator 1500 according to another embodiment are substantially the same as those of the gamma voltage generator according to the previous embodiment, and repeated explanations will be omitted.

While the present invention has been particularly shown and described with reference to certain embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims rather than the foregoing description to indicate the scope of the invention.

What is claimed is:

1. A gamma voltage generator comprising:

a voltage divider configured to generate first to $n^{th}$ voltages, and a gamma voltage output unit configured to receive the first to $n^{th}$ voltages and output first to $n^{th}$ gamma voltages, wherein in a first mode, the first to $n^{th}$ voltages are equal to the first to $n^{th}$ gamma voltages, respectively, wherein in a second mode, $a^{th}$ to $n^{th}$ gamma voltages are higher than the $a^{th}$ to $n^{th}$ voltages, respectively, and a $b^{th}$ gamma voltage has a value between $(b-1)^{th}$ gamma voltage and a $b^{th}$ voltage, where 1<a<n, a≤b≤n and each of a, b and n is a natural number.

2. The gamma voltage generator of claim 1, wherein the voltage divider comprises a resistor array including first to $n^{th}$ nodes to which the first to $n^{th}$ voltages are applied.

3. The gamma voltage generator of claim 2, wherein the resistor array is a single resistor string.

4. The gamma voltage generator of claim 1, wherein in the second mode, the first to $(a-1)^{th}$ gamma voltages are equal to the first to $(a-1)^{th}$ voltages, respectively.

5. The gamma voltage generator of claim 1, wherein in the second mode, the $b^{th}$ gamma voltage is a median value of the $(b-1)^{th}$ gamma voltage and the $b^{th}$ voltage.

6. The gamma voltage generator of claim 1, wherein the gamma voltage output unit includes first to $n^{th}$ sub units configured to output the first to the $n^{th}$ gamma voltages, respectively, wherein the $a^{th}$ sub unit includes a first operator configured to receive the $(a-1)^{th}$ and $a^{th}$ voltages and generate a gamma correction voltage of the $a^{th}$ sub unit, wherein the gamma correction voltage of the $a^{th}$ sub unit has a value between the $(a-1)^{th}$ voltage and the $a^{th}$ voltage.

7. The gamma voltage generator of claim 6, wherein $c^{th}$ sub unit includes a second operator configured to receive a gamma correction voltage of $(c-1)^{th}$ sub unit and a $c^{th}$ voltage and generate a gamma correction voltage of the $c^{th}$ sub unit, wherein the gamma correction voltage of the $c^{th}$ sub unit has a value between the gamma correction voltage of the $(c-1)^{th}$ sub unit and the $c^{th}$ voltage, where a<c≤n and c is a natural number.

8. The gamma voltage generator of claim 7, wherein the $b^{th}$ sub unit further includes a selector configured to output the $b^{th}$ voltage as a $b^{th}$ gamma voltage in the first mode and output the gamma correction voltage of the $b^{th}$ sub unit in the second mode as the $b^{th}$ gamma voltage, where a≤b≤n and b is a natural number.

9. The gamma voltage generator of claim 1, further comprising a gamma reference voltage generator configured to generate a plurality of gamma reference voltages to the voltage divider.

10. A gamma voltage generator comprising:

a voltage divider configured to generate first to $n^{th}$ voltages, and a gamma voltage output unit configured to receive the first to $n^{th}$ voltages and outputs first to $n^{th}$ gamma voltages, wherein the first to $(a-1)^{th}$ gamma voltages are equal to first to $(a-1)^{th}$ voltages, respectively, $a^{th}$ to $n^{th}$ gamma voltages are higher than $a^{th}$ to $n^{th}$ voltages, respectively, $b^{th}$ gamma voltage has a value between $(b-1)^{th}$ gamma voltage and $b^{th}$ voltage, where 1<a<n, a≤b≤n and each of a, b and n is a natural number.

11. The gamma voltage generator of claim 10, wherein the $b^{th}$ gamma voltage is a median value of the $(b-1)^{th}$ gamma voltage and the $b^{th}$ voltage.

12. The gamma voltage generator of claim 10, wherein the gamma voltage output unit includes first to $n^{th}$ sub units configured to output the first to the $n^{th}$ gamma voltages, respectively, and the $b^{th}$ sub unit includes an operator configured to receive the $(b-1)^{th}$ gamma voltage and the $b^{th}$ voltage and generate the $b^{th}$ gamma voltage.

13. An organic light emitting device comprising:

an organic light emitting display panel configured to display an image according to a data signal, a data driver configured to generate the data signal, and a gamma voltage generator configured to generate first to $n^{th}$ gamma voltages to the data driver, wherein the gamma voltage generator comprises:

a voltage divider configured to generate first to $n^{th}$ voltages, and a gamma voltage output unit configured to receive the first to $n^{th}$ voltages and output first to $n^{th}$ gamma voltages, wherein in a first mode, the first to $n^{th}$ voltages are equal to the first to $n^{th}$ gamma voltages, respectively, and in a second mode, $a^{th}$ to $n^{th}$ gamma voltages are higher than $a^{th}$ to $n^{th}$ voltages, respectively, first to $(a-1)^{th}$ gamma voltages are equal to the first to $(a-1)^{th}$ voltages, respectively, and $b^{th}$ gamma voltage has a value between $(b-1)^{th}$ gamma voltage and $b^{th}$ voltage, where $1<a<n$, $a \leq b \leq n$ and each of a, b and n is a natural number.

14. The organic light emitting device of claim 13, wherein the gamma voltage output unit includes first to $n^{th}$ sub units configured to output the first to the $n^{th}$ gamma voltages, respectively, the $a^{th}$ sub unit includes a first operator configured to receive the $(a-1)^{th}$ and $a^{th}$ voltages and generate a gamma correction voltage of the $a^{th}$ sub unit, a $c^{th}$ sub unit includes a second operator configured to receive a gamma correction voltage of a $(c-1)^{th}$ sub unit and $c^{th}$ voltage and generate a gamma correction voltage of the $c^{th}$ sub unit, and $b^{th}$ sub unit further includes a selector configured to output the $b^{th}$ voltage as a $b^{th}$ gamma voltage in the first mode and output the gamma correction voltage of the $b^{th}$ sub unit in the second mode as the $b^{th}$ gamma voltage, where $a \leq b \leq n$ and b is a natural number, the gamma correction voltage of the $a^{th}$ sub unit has a value between the $(a-1)^{th}$ voltage and the $a^{th}$ voltage, and the gamma correction voltage of the $c^{th}$ sub unit has a value between the gamma correction voltage of the $(c-1)^{th}$ sub unit and the $c^{th}$ voltage, where $a \leq b \leq c \leq n$ and each of b and c is a natural number.

15. An organic light emitting device comprising:

an organic light emitting display panel configured to display an image according to a data signal, a data driver configured to generate the data signal, and a gamma voltage generator configured to generate first to $n^{th}$ gamma voltages to the data driver, wherein the gamma voltage generator comprises:

a voltage divider configured to generate first to $n^{th}$ voltages, and a gamma voltage output unit configured to receive the first to $n^{th}$ voltages and output first to $n^{th}$ gamma voltages, wherein first to $(a-1)^{th}$ gamma voltages are equal to first to $(a-1)$ gamma voltages, respectively, and $a^{th}$ to $n^{th}$ gamma voltages are higher than $a^{th}$ to $n^{th}$ voltages, respectively, $b^{th}$ gamma voltage has a value between $(b-1)^{th}$ gamma voltage and $b^{th}$ voltage, where $1<a<n$, $a \leq b \leq n$ and each of a, b and n is a natural number.

16. The organic light emitting device of claim 15, wherein the gamma voltage output unit includes first to $n^{th}$ sub units configured to output the first to the $n^{th}$ gamma voltages, respectively, and the $b^{th}$ sub unit includes an operator configured to receive the $(b-1)^{th}$ gamma voltage and the $b^{th}$ voltage and generate the $b^{th}$ gamma voltage.

* * * * *